US006383701B1

(12) United States Patent
Tohata

(10) Patent No.: US 6,383,701 B1
(45) Date of Patent: May 7, 2002

(54) DEVELOPING AGENT, METHOD FOR MANUFACTURING THE SAME, AND IMAGE FORMING APPARATUS

(75) Inventor: Nobuo Tohata, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,763

(22) Filed: Sep. 26, 2000

(51) Int. Cl.[7] ..... G03G 9/083
(52) U.S. Cl. ..... 430/106.1; 430/137.2
(58) Field of Search ..... 430/106.1, 137.2, 430/106.3

(56) References Cited

U.S. PATENT DOCUMENTS 5,422,215 A * 6/1995 Takagi et al. ..... 430/106.2
5,856,056 A * 1/1999 Omata et al. ..... 430/137.18
5,962,175 A * 10/1999 Tanaka et al. ..... 430/137.18

FOREIGN PATENT DOCUMENTS

JP 3-63660 3/1991

* cited by examiner

*Primary Examiner*—John Goodrow
(74) *Attorney, Agent, or Firm*—Foley & Lardner

(57) ABSTRACT

A developing material is obtained by performing melting and kneading steps, and then a milling step, for a particulate binder resin material having an average particle size of 250 to 600 $\mu$m and a magnetic powder having an apparent bulk density of 0.3 g/cm$^3$ or more and a compacted bulk density of 2.5 g/cm$^3$ or less.

18 Claims, 2 Drawing Sheets

DEVELOPING AGENT, METHOD FOR MANUFACTURING THE SAME, AND IMAGE FORMING APPARATUS

BACKGROUND OF THE INVENTION

The present invention relates to an electrophotographic image forming apparatus, an electrostatic recording type image forming apparatus, and a developing agent used in these apparatuses and, more particularly, to a two-component developing agent containing magnetic toner and carrier and a two-component developing type image forming apparatus.

Generally, when magnetic toner is manufactured by mechanical grinding, the viscosity during melt kneading becomes higher than that of nonmagnetic toner owing to the influence of a magnetic powder added. If the viscosity is too high, an excess shearing force acts on a binder resin to break the resin chain, resulting in easy changes in the resin characteristics. In the manufacture of conventional toner, therefore, in the melt-kneading step kneading must be performed by weakening the shearing force, e.g., lowering the speed of a kneading screw. That is, kneading must be performed by lowering the productivity.

The bulk density of the magnetic powder used is preferably as low as possible because variations in the magnetic characteristics decrease. However, the smaller the bulk density of a powder such as a magnetic powder, the more easily the powder flocculates. So, the magnetic powder cannot easily get intimate with a viscous material such as a binder resin. This makes kneading difficult. When a magnetic powder having low bulk density is subjected to melt-kneading together with a binder resin, the screw cannot well bite into toner particle materials, and this lowers the kneading process amount. It is difficult to improve this lowering of the process amount by the manufacturing conditions. Furthermore, the addition of a small amount of a material (e.g., CCA) other than the magnetic powder also worsens biting of the screw, causing a lowering of the process amount.

For these reasons, the productivity is conventionally ensured by the addition of a magnetic powder having high bulk density. However, the higher the bulk density of a magnetic powder, the larger the variations in the magnetic characteristics between the individual magnetic powder particles. Additionally, uniform dispersion of the magnetic powder is difficult to obtain in a binder resin, so stable magnetic characteristics cannot be obtained. This deteriorates image characteristics such as background development.

Accordingly, it is difficult to achieve both high productivity and good image characteristics only by the bulk density of a magnetic powder.

BRIEF SUMMARY OF THE INVENTION

The present invention has been made in consideration of the problems of the above prior art, and has as its first object to provide a developing agent having superior magnetic characteristics and high productivity and capable of forming high-quality images.

It is the second object of the present invention to provide an image forming apparatus which uses a developing agent having superior magnetic characteristics and high productivity and which can form high-quality images.

According to the first aspect of the present invention, there is provided a developing agent containing toner particles obtained by melting and kneading a particulate binder resin and a magnetic powder to form a mixture, and then milling the mixture, wherein said particulate binder resin material has an average particle size of 250 to 600 $\mu$m and the magnetic powder has an apparent bulk density of not less than 0.3 g/cm$^3$ and a compacted bulk density of not more than 2.5 g/cm$^3$.

According to the second aspect of the present invention, there is provided a method of manufacturing a developing agent, comprising the melt-kneading step of obtaining a kneaded product by melting and kneading a particulate binder resin material having an average particle size of 250 to 600 $\mu$m and a magnetic powder having an apparent bulk density of 0.3 g/cm$^3$ or more and a compacted bulk density of 2.5 g/cm$^3$ or less, and the milling-classification step of obtaining toner particles by milling and classifying the kneaded product.

According to the third aspect of the present invention, there is provided an image forming apparatus comprising a developing unit, transfer unit, and cleaning device arranged in this order around, and opposite to, an image carrier, the developing unit containing a developing agent containing toner particles obtained by melting and kneading a particulate binder resin and a magnetic powder to form a mixture, and then milling the mixture, and carrier, and comprising a developing roller which comprises a hollow cylindrical rotary sleeve for carrying the developing agent and a magnet roll having a plurality of magnetic poles and capable of rotating independently of the sleeve, and a fixing unit placed downstream of the transfer unit and having a pair of fixing rollers.

wherein said particulate binder resin material has an average particle size of 250 to 600 $\mu$m and the magnetic powder has an apparent bulk density of not less than 0.3 g/cm$^3$ and a compacted bulk density of not more than 2.5 g/cm$^3$.

According to the present invention, the manufacture of the developing agent and the dispersion of the magnetic powder are facilitated, and an excellent image can be formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
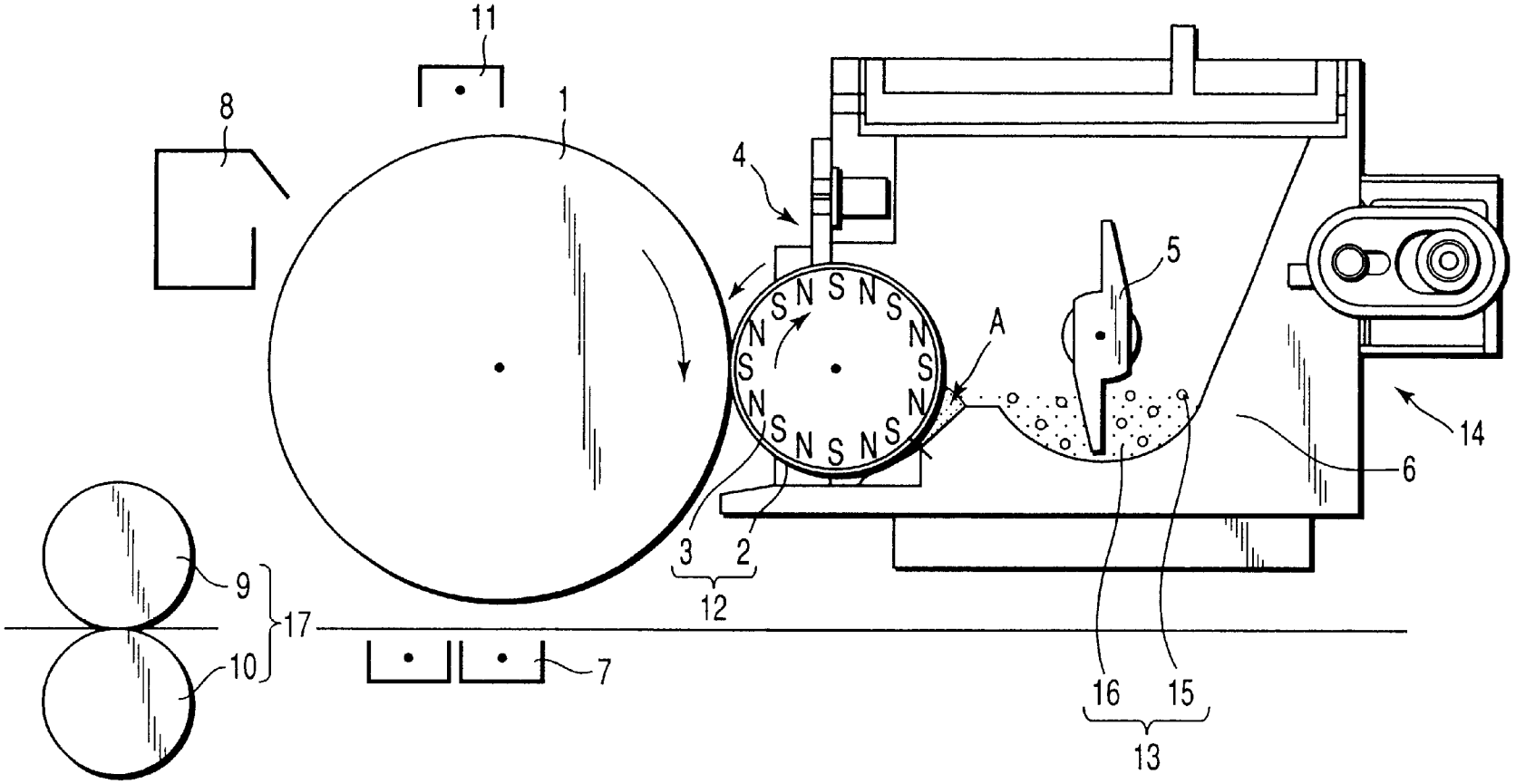
FIG. 1 is a view for explaining an example of a kneader used in a method of manufacturing a developing agent according to the present invention.

A developing agent of the present invention is obtained by using, as raw toner particle materials, a particulate binder resin material having an average particle size of 250 to 600 μm, and a magnetic powder having an apparent bulk density of 0.3 g/cm$^3$ or more and a compacted bulk density of 2.5 g/cm$^3$ or less. This developing agent contains toner particles obtained by melting and kneading, and then milling, these raw toner particle materials.

A developing agent manufacturing method of the present invention is one method of manufacturing the above developing agent and comprises the melt-kneading step of obtaining a kneaded product by melting and kneading a particulate binder resin material having an average particle size of 250 to 600 μm and a magnetic powder having an apparent bulk density of 0.3 g/cm$^3$ or more and a compacted bulk density of 2.5 g/cm$^3$ or less, and the milling-classification step of obtaining toner particles by milling and classifying the kneaded product.

An image forming apparatus of the present invention is an apparatus using the above developing agent and comprises at least one image carrier, a developing unit, transfer unit, and cleaning device arranged in this order around, and opposite to, the image carrier, the developing unit containing a developing agent which contains toner having toner particles obtained by performing melting and kneading steps, and then a milling step, for a particulate binder resin material having an average particle size of 250 to 600 μm and a magnetic powder having an apparent bulk density of 0.3 g/cm$^3$ or more and a compacted bulk density of 2.5 g/cm$^3$ or less, and carrier, and comprising a developing roller which comprises a hollow cylindrical rotary sleeve for carrying the developing agent and a magnet roll having a plurality of magnetic poles and capable of rotating independently of the sleeve, and a fixing unit placed downstream of the transfer unit and having a pair of fixing rollers.

According to the present invention, a magnetic powder having a relatively low bulk density, i.e., having an apparent bulk density of 0.3 g/cm$^3$ or more and a compacted bulk density of 2.5 g/cm$^3$ or less is used as a raw toner particle material in combination with a particulate binder resin material having an average particle size of 250 to 600 μm. This facilitates premixing of the binder resin and the magnetic powder, and also improves the intimacy of the binder resin with the magnetic powder during melt-kneading, thereby improving the productivity of the developing agent. Furthermore, the magnetic characteristics of the magnetic powder itself are more uniform and stabler than magnetic powders having larger particle sizes. Additionally, the magnetic powder well disperses in the obtained toner particles, and the magnetic characteristics of the toner particles are also uniform. Accordingly, high-quality images can be formed. Also, even when an additive such as a charge control agent is added, high-quality images can be formed at low cost without lowing the productivity of the developing agent.

Each of the average particle size of the binder resin and the bulk density of the magnetic powder used in the present invention correlates with the productivity of the toner particles and has large influence on mixing and dispersion with respect to another material. Therefore, the average particle size of the binder resin is 250 to 600 μm. Also, the magnetic powder used in the present invention has an apparent bulk density of 0.3 g/cm$^3$ or more and a compacted bulk density of 2.5 g/cm$^3$ or less.

If at least the average particle size of the binder resin is less than 250 μm or the apparent bulk density is less than 0.3 g/cm$^3$ or less, the bulk of the premixed raw materials decreases. Therefore, in a portion where the free volume decreases in the kneading step, e.g., on the edge of a kneading disk of a kneading screw, the toner particle materials flow in the opposite direction to extremely decrease the kneading process amount. This worsens the productivity of the toner particles.

On the other hand, if at least the average particle size of the resin exceeds 600 μm or the apparent bulk density is less than 0.3 g/cm$^3$, the dispersibility (mixability) of the magnetic powder or CCA in the obtained toner particles worsens to make the magnetic characteristics nonuniform. This leads to a lowering of the image density and deterioration of background development.

The melt index at 150° C. of the binder resin is preferably 2.0 to 8.0 g/10 min. If the melt index is less than 2.0 g/10 min, the viscosity of the toner particles does not well lower in fixing, so low-temperature offset often occurs. If the melt index exceeds 8.0 g/10 min, high-temperature offset often occurs because the viscosity of the toner particles excessively lowers when the temperature of a fixing device rises.

As the binder resin, it is possible to use styrene, a copolymer of substituted styrene, and an acrylic resin, each of which is conventionally used as a binder resin.

As the magnetic powder, it is possible to use any conventionally known magnetic material, e.g., metals such as iron, manganese, cobalt, nickel, and chromium, alloys of these metals, and metal oxides such as chromium oxide, iron sesquioxide, and tri-iron tetroxide.

The addition amount of the magnetic powder to be kneaded in the toner particles is preferably 40 to 65 wt % with respect to the total toner particle weight.

Another characteristic of the magnetic powder is the oil absorption. The oil absorption is the amount of linseed oil necessary to form 100 g of powder samples into one viscous substance. This oil absorption is a characteristic value which represents the intimacy of a powder, in this case a magnetic powder, with oil. The smaller the value of the oil absorption, the more easily the magnetic powder gets intimate with oil. This oil absorption can also have a correlation with mixing and dispersion of the magnetic powder and can influence the productivity of the toner particles.

The oil absorption of the magnetic powder of the present invention is preferably 15 to 25 ml/100 g. If the oil absorption is less than 15 ml/100 g, in the kneading step the magnetic powder gets intimate with the binder resin in molten state before the magnetic powder deflocculates. Since, therefore, the magnetic powder does not evenly disperse in the obtained toner particles, the magnetic characteristics often become nonuniform. This readily causes a lowering of the image density and deterioration of background development. If the oil absorption of the magnetic powder exceeds 25 ml/100 g, the intimacy with the binder resin melted in the kneading step worsens, and the process amount often decreases.

Carrier particles which can be added to the developing agent of the present invention desirably have an average particle size of 10 to 100 μm. Carrier materials to be used are not particularly limited, so various soft magnetic materials can be used. For example, any of Mn—Mg ferrite, Cu—Zn ferrite, and Ni—Zn ferrite can be used.

The average particle size of the magnetic toner particles according to the present invention is desirably 5 to 20 μm. The average particle size of toner particles can be measured by a Coulter counter method. By this method, it is possible to calculate the volumetric particle size from the measured electrical resistance value and obtain a 50% average particle size. As an electrolyte for dispersing the magnetic toner particles in the primary particles, ISOTON II manufactured by Beckman Coulter Inc. can be used.

A charge control agent is desirably added to the toner particles. Examples of the charge control agent are a metal complex of an azo dye and a nigrosine dye. The use of this charge control agent can improve the life of the developing agent.

As an additive which is mixed in the toner particles and adhered to the toner surface, silica particles and a magnetic powder can be primarily used.

The average particle size of the silica particles is preferably about 4 to 50 nm. The addition amount of the silica particles is preferably about 0.1 to 5 wt % with respect to the total toner particle weight. If the silica particle addition amount is less than 0.1 wt %, the resolution often worsens by a defective contact charging step. If the silica particle addition amount exceeds 5 wt %, the cleanability lowers to allow easy contamination of contact charging members.

As described above, the magnetic powder can be kneaded together with the binder resin and can also be further mixed in the obtained toner particles. The average particle size of the magnetic powder is preferably 0.01 to 3 $\mu$m. When this is the case, the addition amount of the magnetic powder is preferably 0.5 to 5 wt % of the total weight of the toner particles. An addition amount less than 0.5 wt % often leads to a lowering of the image density and deterioration of the resolution. An addition amount exceeding 5 wt % often causes an increase in the film peeling amount of a photosensitive body and degradation of the life.

It is also possible to use wax such as low-molecular-weight polypropyrene, low-molecular-weight polyethylene, liquid paraffin, acid amid, wax stearate, montan wax, sazol wax, caster wax, chlorinated paraffin, or carnauba wax in an amount of 0.5 to 5 parts by weight with respect to the total toner particle weight provided that the color reproduction is not influenced.

In the present invention, the melt index (MI) at 150° C. of the toner particles is preferably 1.0 to 7.0 g/10 min. The toner particles are influenced by the resin characteristics and the magnetic powder characteristics. Generally, the viscosity of magnetic toner is higher than that of nonmagnetic toner because a magnetic powder is mixed, so the MI of the magnetic toner decreases. If, however, a shearing force during melt-kneading is strong, the molecular chain of a resin breaks to cause easy flow of the resin as in nonmagnetic toner, and the MI increases. The direction in which the resin particle size decreases or the direction in which the apparent bulk density of the magnetic powder decreases is the direction in which the productivity worsens. If kneading is forcedly performed, a shearing force is applied to the molten toner to break the molecular chain of the resin, and this increases the MI of toner particles.

The MI at 150° C. of toner containing toner particles, a magnetic powder mixed in the toner particles, and an additive such as silica particles is preferably 0.8 to 5.0 g/10 min.

The MI of toner is influenced by the MI of toner particles and the addition amount and particle size of a magnetic powder mixed in the toner particles. Mixing a magnetic powder in toner particles increases the viscosity, so the MI often decreases.

In the melt-kneading step of the method of the present invention, particularly a twin-screw kneader can be preferably used.

A preferably usable twin-screw kneader comprises a cylindrical kneader main body and kneading screws installed in the kneader main body. This kneader main body has a charge port and discharge port. The charge port is formed near one end of the kneader main body to charge a binder resin material and magnetic powder. The discharge port is formed near the other end of the kneader main body to discharge a kneaded product. The kneading screws include at least one kneading disk having a larger diameter than that of the kneading screws. This kneading disk partially decreases the distance to the inner wall to apply a shearing force. All kneading disks are preferably arranged within the range of 5/7 the length of the kneading screws from the discharge port.

FIG. 1 is a view for explaining an example of the structure of screws of a twin-screw kneader.

As shown in FIG. 1, this twin-screw kneader has eight cylinder blocks 111, 112, 113, 114, 115, 116, 117, and 118 airtightly connected together to form one cylinder 100, and two screws 110 installed in this cylinder 100 and having a diameter slightly smaller than the inside diameter of the cylinder 100. The cylinder block 111 has a charge port 201 for charging toner particle materials. The cylinder block 118 has a discharge port 202 for discharging the obtained kneaded product. The screws 110 have kneading disks 101, 102, and 103 for partially decreasing the distance to the inner wall of the cylinder 100 and applying a shearing force to the kneaded product. In the apparatus according to the present invention, none of these kneading disks 101, 102, and 103 exists in cylinders beyond the fifth block (length y) from the discharge port with respect to a whole length x of the cylinder 100. This is to prevent a back flow of unmelted raw lag materials. Hence, the kneading screws preferably have no kneading disk in cylinders beyond the fifth block from the molten product discharge port. The number of cylinder blocks is usually 7 to 10.

In FIG. 1, the overall length of the cylinder 100 is, e.g., 1,400 mm, and y is 800 mm.

In the kneader shown in FIG. 1, while the interior of the cylinder is heated to 90° C. by a heating means (not shown), premixed toner particle materials including a binder resin, magnetic powder, charge control agent, and the like are supplied from the charge port 1. A kneaded product obtained by the screws rotating at, e.g., 200 $min^{-1}$ is discharged from the discharge port 2. The necessary time from the charge of the toner particle materials to the discharge is, e.g., approximately 1 min.

As a toner particle material melt-kneading means, a melt-kneading method using, e.g., a roll, pressure coater, or internal mixer can be used in place of the twin-screw kneader.

As a premixing means, it is possible to use a ball mill, V mixer, Vorberg, Henschel mixer, or the like.

Also, as a means for coarsely grinding the obtained kneaded product, a hammer mill, cutter mill, roller mill, ball mill, or the like can be used.

As a means for finely grinding the coarsely ground product, a jet mill or a high-speed rotary grinder can be used.

Furthermore, an air classification apparatus or the like can be used as a means for classifying the finely ground product.

An example of the method of adding the magnetic powder, silica particles, and the like to the obtained toner particles is a method using a high-speed rotary mixer represented by a Henschel mixer. Additives can be added simultaneously or separately in accordance with their types. That is, additives can be mixed by choosing the most effective conditions.

The present invention will be described in detail below with reference to the accompanying drawing.

Figure 2:
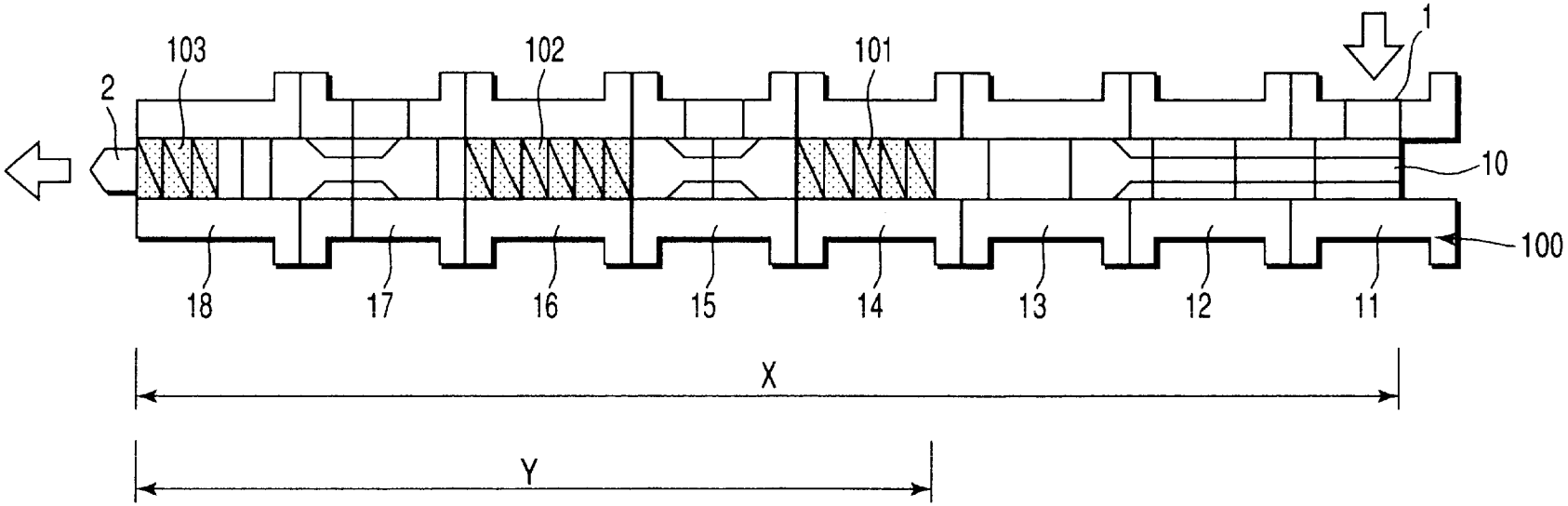
FIG. 2 is a schematic sectional view showing an example of an image forming apparatus according to the present invention.

FIG. 2 is a schematic view showing an example of an image forming apparatus of the present invention.

As shown in FIG. 2, this image forming apparatus basically comprises a photoreceptor drum 1 as an image carrier, and a developing unit 14, a transfer unit 7, a cleaning device 8, and a charger 11 arranged in this order around the photoreceptor drum 1. The apparatus also has a fixing device 17 placed after the transfer unit 7 and having a pair of fixing rollers 9 and 10.

The photoreceptor drum 1 carries an electrostatic image on its surface and rotates in the direction of an arrow. The developing unit 14 faces the photoreceptor drum 1 and has the following components. In the developing unit 14, a developing agent container 6 is formed integrally with an enclosure capable of attaching a toner cartridge in the upper portion. This developing agent container 6 contains a developing agent 13 according to the present invention which contains toner 16 and carrier 15 according to the present invention. A developing roller 12 is placed in a position at the lower end of this developing agent container 6, where the developing roller 12 opposes the photoreceptor drum 1. This developing roller 12 includes a hollow cylindrical developing sleeve 2 made of a nonmagnetic material, and a magnet roller 3 contained in this developing sleeve 2. This magnet roller 3 extends in the axial direction and has a plurality of magnetic poles. The developing sleeve 2 and the magnet roller 3 can rotate coaxially and relative to each other. In this developing unit, the developing sleeve 2 rotates counterclockwise, and the magnet roller 3 rotates clockwise. This makes the rotating direction of the developing agent equal to its conveyance direction, so the conveyance amount can be increased. This further increases the speed of development. Reference numeral 4 denotes a developing agent regulating blade made of a nonmagnetic substance. A stirrer 5 stirs the developing agent 13 to prevent its flocculation and conveys the developing agent 13 to the developing roller 12.

The gap between the photoreceptor drum 1 and the developing sleeve 2 is 0.35 mm. The gap between the developing agent regulating blade 4 and the developing sleeve 2 is 0.30 mm.

The magnetic toner is stirred and followed by the stirrer 5 and supplied to a developing agent magnetic attraction region A. The magnetic toner magnetically attracted in this developing agent magnetic attraction region A is attracted onto the developing sleeve 2. While being rotated by the rotation of the magnet roller 3, the magnetic carrier 15 is stirred together with the toner 16 and charged.

The ratio of the toner weight to the weight of the developing agent on the developing sleeve 2, i.e., the toner specific density changes around, e.g., about 50%. The toner amount with respect to the magnetic toner is larger than in a conventional magnet fixed type two-component development system. In this conventional magnet fixed development system, if the toner density does not change within the range of toner specific density±1 wt %, image defects such as carrier transfer and density lowering take place. Therefore, the toner specific density must be strictly controlled. In the magnet rotating development system, no image defect occurs even against a variation of toner specific density±20 wt %. The developing agent conveyed on the sleeve 2 is given a defined developing layer thickness by passing through the developing agent regulating blade 4 and developed to visualize a latent image on the photoreceptor drum 1.

The present invention will be described in more detail below by way of its examples.

EXAMPLE 1

A composition A described below was mixed by a Henschel mixer and kneaded by a twin-screw kneader PCM45 (manufactured by IKEGAI CORP.) having the same structure as shown in FIG. 1. The overall length x of the cylinder 100 was 1,400 mm, and the length to a kneading disk farthest from the discharge port was 800 mm. After that, the obtained kneaded product was cooled and coarsely milled by a hammer mill. The coarsely milled product was then finely milled by a jet-impact mill. Subsequently, the excess fine powder was removed by an air classification apparatus to obtain toner particles.

| Toner particle composition A | |
|---|---|
| Styrene acryl resin CPR-100 (Mitsui Kagaku) average particle size 400 $\mu$m MI 5 g/10 min | 48 wt % |
| Internally added magnetic powder EPT-1000 (TODA KOGYO CORP.) apparent bulk density 0.6 g/cm$^3$ compacted bulk density 1.6 g/cm$^3$ average particle size 0.3 $\mu$m | 50 wt % |
| CCA T-95 (Hodogaya Chemical Co., Ltd.) | 2 wt % |

Additives having the following composition were mixed in 100 parts by weight of the toner particles obtained as above.

| Additive composition | |
|---|---|
| Silica particles R972 (Nippon Aerosil Corporated) average particle size 16 nm | 0.7 parts by weight |
| Magnetic powder EPT-1000 (TODA KOGYO CORP.) average particle size 0.3 $\mu$m | 1.5 wt % |
| Zinc stearate (NIPPON OIL & FATS CO., LTD.) | 0.5 wt % |

The above additives were put into the same vinyl bag and preliminarily stirred. The obtained mixture was stirred at an appropriate rotational speed of, e.g., 100 min$^{-1}$ for 3 min by a Henschel mixer. Finally, the resultant material was screened to obtain toner.

The obtained toner had high productivity and high dispersibility. The MI of the toner particles was 3.0 g/10 min, and the MI of the toner was 2.0 g/10 min.

The obtained toner was measured and evaluated as follows.

Measurement of Particle Size of Binder Resin

Measurement Using Vibratory Screen

Equipment used: Vibratory screen manufactured by Tsutsui Rikagaku K.K.

Mesh size used: Diameter 200 mm

Open mesh size: 2, 1.4, 0.6, 0.25, and 0.106 mm were combined.

150 g of a sample were screened through the vibratory screen for 15 min by using the combined meshes of the above five types. The average particle size was calculated from the remaining amount on each mesh.

Magnetic Powder Bulk Density

Measurement of Apparent Bulk Density

The apparent bulk density was measured in accordance with JIS K-5101-1991 20.1.

First, a bulk meter was placed horizontally, a screen having an open mesh size of 0.5 mm was attached to a funnel, and a receiver was placed immediately below the funnel.

A sample was placed on the screen and evenly slightly loosened on the entire screen surface by a painting brush. Consequently, the sample dispersedly fell on the receiver.

When the receiver was heaped with the sample, the sample was leveled by a spatula.

The sample weight on the receiver was measured, and the apparent bulk density was calculated.

{apparent bulk density (g/cm$^3$)}={sample (g) in receiver}{receiver volume (cm$^3$)}

Compacted Bulk Density

The compacted bulk density was measured using a tap tester (KRS-406 manufactured by Kuramochi Kagakukikai Seisakusho).

First, a 25-ml messcylinder was stood on a funnel base.

About 10 to 20 g of a sample were passed through a 32-mesh screen while being loosed by a brush.

5 to 10 g of the adjusted sample were weighed by an even balance and gently placed in the 25-ml messcylinder.

The messcylinder was set in the tap tester and tapped 600 times.

The volume of the sample in the messcylinder was read to a scale of 0.1 ml, and the compacted bulk density was calculated.

{compacted bulk density (g/cm$^3$)}={hardened density (g/ml)}={sample weight (g)}/{sample volume (cm$^3$)}

Measurement of Melt Index (MI) at 150° C.

The melt index was measured on the basis of the measurement manual of a melt indexer (Toyo Seiki).

First, the furnace temperature of the melt indexer was adjusted to 150° C.

About 5 g of a sample were put into a sample hole and compacted by a piston on which a 1,835-g weight was placed.

After the piston descended to a predetermined position, the pushed outgoing sample was taken with scissors every predetermined seconds, and the average value of three points or more except for the maximum and minimum values was calculated.

MI (g/10 min)={outflow amount (g)}/{cut time (sec)}*600

Evaluation of Productivity

When the screw rotational speed of the melt kneader PCM 45 (manufactured by IKEGAI CORP.) was 200 min$^{-1}$ or less, the productivity was ○ if the process amount was 50 kg/H or more; the productivity was X if the process amount was less than 50 kg/H.

Evaluation of Dispersibility

The Fe values of toner particles and a fine classified powder were measured using a fluorescent X-ray RIX2000 (manufactured by Rigaku). The dispersibility was evaluated by the following Fe dispersion index.

(Fe dispersion index)={toner matrix particle Fe value (kcps)}/{fine classified powder Fe value (kcps)}

The dispersibility was ○ if the obtained Fe dispersion index satisfied $0.9 \leqq$(Fe dispersion index)$\leqq 1.1$. The dispersibility was X if (Fe dispersion index)$<0.9$ or $1.1<$(Fe dispersion index).

The obtained results are shown in Table 1 below.

EXAMPLES 2–6 & COMPARATIVE EXAMPLES 1–5

Toner components were formed following the same procedures as in Example 1 except that the average particle size and melt index of the binder resin, the apparent bulk density and compacted bulk density of the magnetic powder, and the oil absorption were changed as shown in Table 1 below.

The obtained toner components were measured and evaluated following the same procedures as in Example 1.

In Example 6, a kneading disk 201 was placed in a position on the screw 1,070 mm away from the discharge port. That is, a kneading disk was present in a position beyond the fifth block from the discharge port. Except for this Example 6, a kneader having the same structure as the kneader used in Example 1 was used.

TABLE 1

| | Toner particle materials | | | | | | | | |
|---|---|---|---|---|---|---|---|---|---|
| | Resin characteristics | | Magnetic powder characteristics | | | Toner particle | Toner | | |
| | Average particle size (μm) | MI (150° C.) (g/10 min) | Apparent bulk density (g/cm$^3$) | Compacted bulk density (g/cm$^3$) | Oil absorption (mL/100 g) | characteristics MI (150° C.) (g/10 min) | characteristics MI (150° C.) (g/10 min) | Productivity | Magnetic powder dispersion |
| Example 1 | 400 | 5 | 0.6 | 1.6 | 20 | 3.0 | 2.0 | ○ | ○ |
| Example 2 | 250 | 8 | 0.3 | 0.8 | 15 | 7.0 | 5.0 | ○ | ○ |
| Example 3 | 600 | 2 | 1.2 | 2.5 | 25 | 1.0 | 0.8 | ○ | ○ |
| Comparative Example 1 | 200 | 5 | 0.6 | 1.6 | 20 | 7.2 | 5.1 | X | ○ |
| Comparative Exanple 2 | 650 | 5 | 0.6 | 1.6 | 20 | 0.8 | 0.7 | ○ | X |
| Comparative Example 3 | 400 | 5 | 0.2 | 0.7 | 20 | 7.2 | 5.5 | X | ○ |
| Comparative Example 4 | 400 | 5 | 1.2 | 2.6 | 20 | 0.7 | 0.7 | ○ | X |
| Example 4 | 400 | 5 | 0.6 | 1.6 | 26 | 7.5 | 5.1 | Δ | ○ |
| Example 5 | 400 | 5 | 0.6 | 1.6 | 14 | 0.7 | 0.5 | ○ | Δ |
| Example 6 | 400 | 5 | 0.6 | 1.6 | 20 | 8.0 | 6 | Δ | ○ |

As shown in Table 1, when the average grain size of the binder resin material was smaller than the range of the present invention as in Comparative Example 1, the melt index rose to degrade the productivity. When the average particle size was too large as in Comparative Example 2, the melt index lowered to worsen the dispersibility of the magnetic powder.

When the apparent bulk density was lower than the values applied in the present invention as in Comparative Example 3, the melt index rose to worsen the productivity. When the compacted bulk density was lager than the values applied in the present invention as in Comparative Example 4, the melt index lowered to deteriorate the dispersibility of the magnetic powder.

In contrast, good characteristics were obtained by the developing agents of Examples 1 to 6. In Example 4, the oil absorption exceeded 25 ml/100 g. Therefore, the melt index rose and the productivity slightly degraded. In Example 5, the oil absorption was lower than 15 ml/100 g, so the melt index lowered and the dispersibility of the magnetic powder slightly worsened. In Example 6, a kneading disk was present in a position beyond the fifth block from the discharge port. This caused a back flow of the unmelted toner particle materials. Consequently, the melt index rose to slightly deteriorate the productivity.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent containing toner particles obtained by melting and kneading a particulate binder resin and a magnetic powder to form a mixture, and then milling the mixture, wherein said particulate binder resin material has an average particle size of 250 to 600 $\mu$m and the magnetic powder has an apparent bulk density of not less than 0.3 g/cm$^3$ and a compacted bulk density of not more than 2.5 g/cm$^3$.

2. A developing agent according to claim 1, wherein the apparent bulk density is 0.3 to 3.0 g/cm$^3$, and the compacted bulk density is 0.3 to 2.5 g/cm$^3$.

3. A developing agent according to claim 1, wherein said toner particles have a melt index of 1.0 to 7.0 g/10 min at 150° C.

4. A developing agent according to claim 1, wherein said magnetic powder has an oil absorption of 15 to 25 ml/10 g.

5. A developing agent according to claim 1, wherein said magnetic powder has an average particle size of 0.01 to 3 $\mu$m.

6. A developing agent according to claim 1, wherein an addition amount of said magnetic powder is 40 to 65 parts by weight with respect to 100 parts by weight of said toner particles.

7. A developing agent according to claim 1, further containing a magnetic powder mixed in said toner particles.

8. A developing agent according to claim 7, wherein a mixing amount of said magnetic powder mixed in said toner particles is 0.5 to 5 wt % with respect to said toner particles.

9. A method of manufacturing a developing agent, comprising:

the melt-kneading step of obtaining a kneaded product by melting and kneading a particulate binder resin material having an average particle size of 250 to 600 $\mu$m and a magnetic powder having an apparent bulk density of not less than 0.3 g/cm$^3$ and a compacted bulk density of not more than 2.5 g/cm$^3$; and the milling-classification step of obtaining toner particles by milling and classifying said kneaded product.

10. A method according to claim 9, wherein the melt-kneading step is performed by using a kneader comprising a cylindrical kneader main body having a charge port formed near one end of said kneader main body to charge a binder resin material and magnetic powder and a discharge port formed near the other end of said kneader main body to discharge said kneaded product, and a kneading screw installed in said kneader main body, said kneading screw has at least one kneading disk having a diameter larger than a diameter of said kneading screw and adapted to apply a shearing force by decreasing a distance to an inner wall of said kneader main body, and all of said kneading disks are arranged within a range of 5/7 the length of said kneading screw from said discharge port.

11. A method according to claim 9, wherein the apparent bulk density is 0.3 to 3.0 g/cm$^3$, and the compacted bulk density is 0.3 to 2.5 g/cm$^3$.

12. A method according to claim 9, wherein said toner particles have a melt index of 1.0 to 7.0 g/10 min at 150° C.

13. A method according to claim 9, wherein said magnetic powder has an oil absorption of 15 to 25 ml/10 g.

14. A method according to claim 9, wherein said magnetic powder has an average particle size of 0.01 to 3 $\mu$m.

15. A method according to claim 9, wherein an addition amount of said magnetic powder is 40 to 65 parts by weight with respect to 100 parts by weight of said toner particles.

16. A method according to claim 9, further comprising the mixing step of mixing a magnetic powder in said toner particles.

17. A method according to claim 16, wherein a mixing amount of said magnetic powder mixed in said toner particles in the mixing step is 0.5 to 5 wt % with respect to said toner particles.

18. A developing agent containing toner particles obtained by melting and kneading a particulate binder resin and a magnetic powder to form a mixture, and then milling the mixture, wherein said particulate binder resin material has an average particle size of 250 to 600 $\mu$m and the magnetic powder has an apparent bulk density of not less than 0.3 g/cm$^3$ and a compacted bulk density of not more than 2.5 g/cm$^3$, wherein said magnetic powder has an oil absorption of 15 to 25 ml/10 g, and wherein said developing agent includes a charge control agent.

* * * * *